United States Patent [19]

Paul

[11] 4,421,058

[45] Dec. 20, 1983

[54] CAT PORTS

[76] Inventor: Graham R. Paul, 29 Haliburton Rd., Twickenham, Middlesex, England

[21] Appl. No.: 18,009

[22] Filed: Mar. 7, 1979

[30] Foreign Application Priority Data

Mar. 8, 1978 [GB] United Kingdom ..... 9164/78
May 30, 1978 [GB] United Kingdom ..... 9164/78

[51] Int. Cl.[3] ..... E06B 3/32

[52] U.S. Cl. ..... 119/19; 160/92; 335/153

[58] Field of Search ..... 119/19, 51 R; 160/179, 160/180, 92; 49/171; 335/153

[56] References Cited

U.S. PATENT DOCUMENTS

| | | | |
|---|---|---|---|
| 3,305,805 | 2/1967 | Tann | 335/153 |
| 3,976,962 | 8/1976 | Seeley | 335/153 |
| 4,022,263 | 5/1977 | Beckett et al. | 160/180 |
| 4,039,985 | 8/1977 | Shlesinger, Jr. | 335/153 |
| 4,043,079 | 8/1977 | Smith | 119/19 |
| 4,126,841 | 11/1978 | Maeno | 335/153 |

*Primary Examiner*—Jay N. Eskovitz
*Attorney, Agent, or Firm*—Merriam, Marshall & Bicknell

[57] ABSTRACT

This invention is concerned with devices for controlling movement of small animals, of the kind commonly known as "Cat Ports". The device is activated by an operating magnet worn by the small animal, which when the animal moves to pass through the device, closes a reed switch. The reed switch is adjustably prebiased by a positionally adjustable permanent magnet, to afford the reed switch with a desired sensitivity, and a control circuit includes a re-setting coil to return the reed switch to its open position after a predetermined time interval. The device may readily be modified to control movement of animals in either, or both directions, to and from a designated area.

8 Claims, 7 Drawing Figures

CAT PORTS

BACKGROUND OF THE INVENTION

The invention relates to a device to allow or prevent passage of a small animal into or from a designated. area: such devices are generically referred to as "Cat Ports", and are generally provided in a door or wall of domestic premises to enable a domestic animal (usually a cat) to enter and leave the premises at will.

Conventional cat ports are generally of the kind comprising a flap pivotally mounted in an opening which is of a size sufficient to allow passage therethrough of the small animal. The flap is usually mounted for movement about a horizontal pivot axis extending through an upper part of the opening, parallel to the plane of the main door or wall, in a manner such that the flap will drop under its own weight into a generally vertical disposition to close the opening, but such that it can be moved, by pressure applied to a lower part thereof, in either direction to allow the small animal to pass to and from the domestic premises.

Whereas it is normal to provide a manually operated lock on such a cat port, to be effective the flap must be capable of being lifted by the small animal as and when it pleases. Unfortunately, it is not uncommon for neighbouring cats, particularly strays, to learn to use the cat port, and follow a cat through the port into the domestic premises. This can have undesirable consequences.

DISCUSSION OF THE PRIOR ART

It has been suggested in U.S. Pat. No. 4,022,263 to provide a cat port with a solenoid-powered catch which is moved to a release position to free the flap by closure of a reed switch, which is effected magnetically by an operating magnet attached to a collar of the animal. In said U.S. Patent, the reed switch used is relatively insensitive, and is of the type which necessitates contact, or at least very close proximity, between the switch and the magnet. This necessitates the provision of guiding means (provided in said Patent by an iris 15) firstly to provide a mounting for the reed switch within the opening through which the animal passes, and secondly to ensure that, as the animal approaches the flap, its head moves through a specific position so as to ensure actual physical contact between the reed switch and the operating magnet.

The requirement for such guiding means produces several disadvantages. Firstly it increases the complexity of construction of, and hence the cost of, the cat port. Secondly it increase the thickness of the cat port to an extent which effectively prevents the cat port from being mounted on a door of the premises, and necessitates the inconvenience of mounting the cat port in a wall of the premises. Thirdly, the guiding means is of a construction which, should the catch fail to be moved to its release position, would trap the animal with its head in the interior chamber.

A solution to these problems would seem to be provided by the use of a more sensitive reed switch, which may be activated by a lesser degree of proximity between the reed switch and the operating magnet. This in theory would allow the guiding means to be dispensed with. However in practice, a more sensitive reed switch when used in this context encounters several major problems. Firstly, the sensitivity of a sensitive reed switch is not a fixed function, and depends inter alia on the orientation of the reed switch when mounted in position (that is, whether it is mounted with its longitudinal axis north/south, or east/west). Further, a sensitive reed switch might be closed upon initiation of operation of adjacent electrical equipment, such as refrigerator motors. Secondly, if a sensitive reed switch were used which could be activated by an operating magnet at a distance for example of two inches, the hysteresis characteristics of the reed switch would probably be effective to maintain the switch closed subsequent to removal of the operating magnet beyond its effective distance.

Further, in the construction illustrated in U.S. Pat. No. 4,022,263, it is impossible readily to modify the cat port to enable it to control exit of a small animal from the premises. Such control (or the capability of such control) is highly desirable when it is desired to prevent an animal, or one of several animals, from leaving the premises should for example the animal come into season.

It is one of the various objects of this invention to provide a cat port which will overcome some at least of the disadvantages set out above.

Further it is specified in U.S. Pat. No. 4,022,263 that "As the cat leaves the box, the door 23 will be raised so high that gravity will swing it back through its centre, depressing the catch 27 as it goes by and causing it to be caught in the position shown at 23*a*." This presumes that the animal passes through the cat port in a continuous movement, and observers of cats in particular will recognise that this frequently does not happen. Often, the cat will pass partly through the cat port, and at leisure move completely through, often the tail of the cat remaining sometime within the opening. In the construction illustrated in said U.S. Patent, this would be effective to prevent the flap from returning to its latched position, and this would allow other animals to enter behind the cat wearing the operating magnet. No ready solution to this problem is obvious, since in said U.S. Patent, the reed switch will return to its closed position immediately after contact with the magnet is broken, and this necessarily requires the provision of means to free the flap prior to actual movement of the head of the cat into contact with the flap.

BRIEF SUMMARY OF THE INVENTION

According to this invention there is provided a cat port comprising:

(a) a frame defining an opening through which a small animal must pass to gain access to, or exit from a designated area, and (b) a flap mounted on the frame within said opening for pivotal movement in both directions from a closed position in which the flap substantially closes the opening, the cat port comprising means for controlling movement of the flap from its closed position, said means comprising:

(i) catch means mounted on the frame and which is movable between an operative position in which it restrains pivotal movement of the flap in at least one of said directions and an inoperative position in which such pivotal movement is permitted, and (ii) operating means mounted on the frame and which may be rendered operative under the action of a magnet carried by the small animal on movement thereof into close proximity with the cat port to move the catch means to its inoperative position, said operating means comprising a magnetically responsive switch mounted on the frame, and a permanent magnet mounted adjacent to said switch, the relative dispositions of the magnetically responsive switch and the permanent magnet being adjustable to vary the operating threshold of the switch.

In this manner, when the cat port is mounted in position on for example a main door of a domestic premises, the relative dispositions of the magnetically responsive switch and the permanent magnet may be adjusted, to take the magnetically responsive switch closed to the point of tripping. In this manner, the magnetically responsive switch may be provided with a desired sensitivity, irrespective of the orientation of the cat port in relation to the earths magnetic field, or adjacent electrical equipment. The need for contact between the magnet worn by the small animal and the magnetically responsive switch is thus dispensed with. This in turn permits the operating means to be activated by a small animal approaching the cat port from either direction, if this is required.

Preferably the magnetically responsive switch and the permanent magnet are mounted on the frame in a manner permitting their magnetic orientations relative to the openings to be reversed. This permits the possibility of ensuring that the operating means is activated only by a magnet suspended from a collar worn by the small animal in a specific orientation (for example, south pole lowermost) and the operating means will not be activated by a magnet worn by another small animal in opposite orientation (e.g. north pole lowermost) thus, where two cat ports in accordance with this invention are installed in adjacent domestic premises, the cat ports may be arranged so that the animals residing in the neighbouring premises are excluded from entry, into their neighbours houses.

Advantageously the frame is formed to provide a housing extending beneath the opening, the magnetically responsive switch being located in the housing at a position generally beneath the flap when in its closed position. In this manner, the magnetically responsive switch may be activated by the magnet worn by a small animal approaching the cat port in either direction. This permits not only the control of entry into the domestic premises, but also permits the control of exit from the domestic premises. Thus, should the cat port be used for the control of a number of small animals residing in one domestic premises, one of the small animals may be selectively denied exit by removal of the magnet from its collar. This is particularly useful when it is desired that one of the small animals should be prevented from leaving the premises, as may be necessary when the animal is ill, or comes into season.

Convenienently the magnetically responsive switch is provided by a reed switch, and there is provided a re-setting means to render the reed switch inoperative (i.e. open) subsequent to activation of the said switch.

In this manner, the reed switch may be maintained closed subsequent to activation, for example by virtue of the hysteresis characteristics of the reed switch, maintaining the catch means in its inoperative position, whilst the small animal passes completely through the cat port, and the flap returns to its closed position. Thus, the possibility of the flap returning to its closed position after a return of the catch to its operative position, which could be effective to allow subsequent opening of the flap with the catch remaining in its operative position, is significantly minimised.

The re-setting means may comprise a further permanent magnet mounted on the flap, and which is so positioned that, on return of the flap to its closed position subsequent to the passage of a small animal through the opening, said further permanent magnet renders the reed switch inoperative. Alternatively, a control circuit may comprise a re-setting coil, and timing means to cause electric current to be applied to the re-setting coil to cause the coil to generate a re-setting magnetic field, subsequent to the elapse of a predetermined interval of time subsequent to activation of the reed switch.

This invention also provides, for use in the control of a cat port comprising a frame defining an opening and a flap mounted on the frame in said opening for pivotal movement from a position in which it closes the opening, a control device for controlling movement of the flap from its closed position, said control device comprising:

(a) a housing adapted to be mounted adjacent to a lower boundary of the opening, (b) catch means mounted in the housing and which is movable between an operative position in which it restrains pivotal movement of the flap in at least one direction from its closed position, and an inoperative position in which such pivotal movement is not restrained, and (c) operating means mounted in the housing which at rest is inoperative and which may be rendered operative under the action of a magnet carried by a small animal on movement of the small animal into close proximity with the cat port, said operating means being operative to move the catch means to its inoperative position, said operating means comprising a magnetically responsive switch mounted on the housing, and adjustable biasing means which may be adjusted to set the operating threshold of the switch at a desired level.

DETAILED DESCRIPTION OF THE PREFERRED EMBODIMENT

Figure 1:
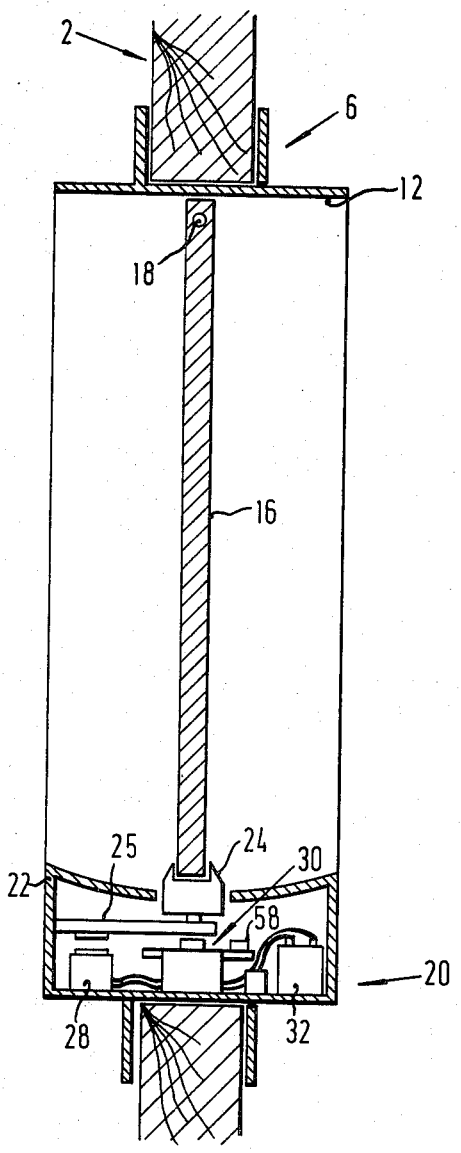
FIG. 1 is a side sectional view showing the cat port which is the preferred embodiment of this invention, mounted in an aperture of a main door of domestic premises.

The cat port which is the preferred embodiment of this invention comprises a frame generally indicated by the numeral 6 adapted to be mounted in an aperture of a door 2, such as the main exterior door of a kitchen of domestic premises. The cat port is particularly designed to control movement of cats or small dogs to and/or from the domestic premises, but it will be appreciated that it may be used to control the movement of animals other than domestic pets to and/or from other designated areas.

Frame 6 defines an open 12, sufficiently large to permit passage therethrough of a small animal, and mounted on pivot pins 18 within the opening 12 is a door in the form of a flap 16. The flap 16 is such that, at rest it hangs under gravity in the position shown in FIG. 1, in which it substantially closes the opening 12, but may be moved, in either direction, by a relatively light pressure, to an open position, such as it illustrated in dotted lines in FIG. 2, which it will adopt on the passage of a small animal through the opening either to or from the premises.

The frame 6 provides, beneath the opening 12, housing 20, which is provided with a closable lid 22. In the housing is mounted a catch 24 which is movable generally vertically on a pivot arm 25 between an inoperative position in which the flap 16 is free to move in either pivotal direction, and an operative position, in which the catch is effective to prevent movement of the door in either direction from the closed position, movement of the catch between said two positions being effective by a solenoid 28 acting on the arm 25.

Also mounted in the housing is an operating circuit including a battery 32, magnetically operable switch, which in the preferred embodiment is in the form of a reed switch 30, which may be moved from an open to a closed condition by the action of a small magnet suspended from a collar worn by the small animal, closure of the circuit effecting energisation of the solenoid 28, which moves the catch 24 from its operative to its inoperative position to free the flap 16 for pivotal movement.

Figure 5:
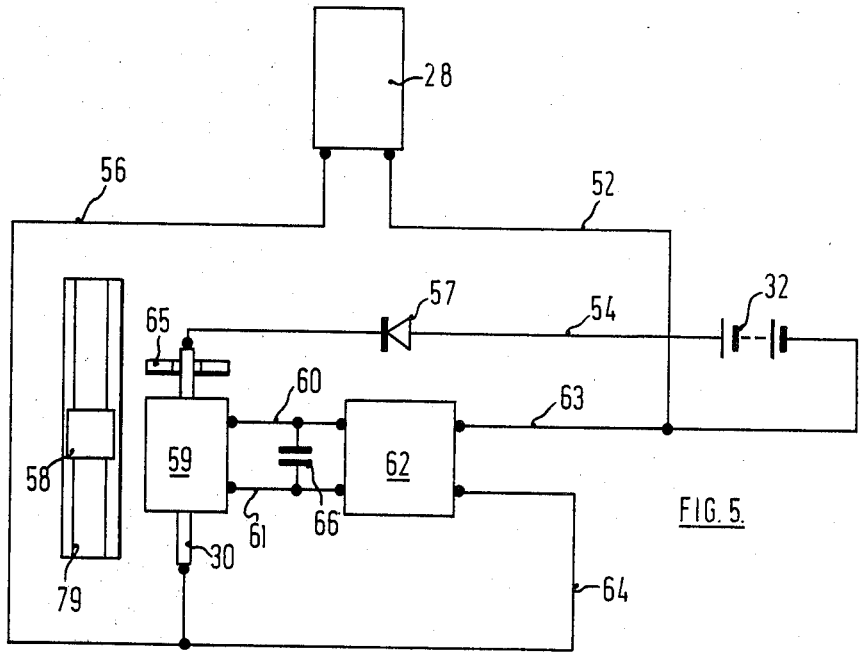
FIG. 5 is a circuit diagram of operating means of the cat port.

The operating means of the preferred embodiment, arranged to control the position of the catch 24, comprises an operating circuit, illustrated in FIG. 5 of the drawings. From this figure, it will be seen that the solenoid 28 has one end of its coil connected directly by line 52 to the negative pole of the battery 32. The positive pole of the battery is connected to the other end of the solenoid coil by a line 54 through the normally-open reed switch 30 and line 56, a diode 57 being incorporated in the line 54.

A permanent magnet 58 is mounted in the housing, being slidable along a fixed trackway 79, to a position and an orientation in which its magnetic field biases the reed switch 30 so that it is just on the point of closing. The magnet 58 is positionally adjustable to enable the optimum position to be obtained subsequent to the mounting of the cat port in the desired position, and enables compensation to be made for the earths magnetic field, and other environmental factors which may alter the operating parameters of the reed switch 30. The magnet 58 may also be adjusted after a period of use, as may be necessary when the power generated by the battery 32 falls. Additionally, by reversing the reed switch and resetting the position of the magnet 58, the polarity of the magnetic field which will activate the reed switch 30 may be changed.

A re-setting coil 59 surrounds the reed switch 30, the ends of the coil 59 being connected by lines 60 and 61 to a timing device 62, a capacitor 66 being connected between the lines 60 and 61. The timing device 62 is connected directly to the negative terminal of the battery 32 by line 63, and to the positive terminal of the battery 32 by the line 64, reed switch 30 and line 54.

A strip 65 of magnetic material having a low coersivity, such as mild steel, may if desired be mounted at right angles to the direction of motion of the animal through the cat port, the reed switch protruding through the strip 65.

The reed switch 30 is operated (that is, closed) by the magnetic field of predetermined polarity produced by a small key magnet suspended from a collar worn around the neck of an animal to be allowed to pass through the cat port. The magnet is suspended with either its north or south pole facing downwards, depending upon the polarity which will actuate the reed switch. The approach of the animal wishing to pass through the cat port in either direction and bearing a key magnet of the correct polarity causes the reed switch 30 to close, thereby energising solenoid 28 and moving the catch 24 to its inoperative position, freeing the flap 16. Once the switch 30 has been closed, the hysteresis of the switch is such that, unless positively re-opened the reed switch will remain closed even after the key magnet has been removed.

Closure of the reed switch 30 also supplies power to and starts the timing device 62. After a preset delay, the timing device energises the re-setting coil 59 which generates a magnetic field of a polarity such as to open the reed switch 30. The timing device 62 is conveniently adjustable, and may for example provide a delay of between 1 to 10 seconds. Opening of the reed switch 30 de-energises solenoid 28, allowing the spring-loaded catch 24 to return to its normal, closed position, opening of the reed switch also terminating the supply of power to the timing device 62 and the re-setting coil 59 whose magnetic field is prevented from collapsing too quickly by the capacitor 66. Thus no current is drawn when the reed switch is open, and hence it is possible to operate the lock from a relatively low power battery.

The return of the catch 24 to its operative position after the preset time effectively ensures that this does not happen until the small animal has passed completely through the opening 12, and the flap 16 has returned to its closed position, ensuring that the return of the catch to its operative position is effective to prevent the flap being caught behind the closed catch, in a position in which it is free to move in one pivotal direction without activation of the operating circuit.

It will be appreciated that it may be desirable to provide the flap with damping means, for example in the form of small rubber friction pads, to prevent prolonged swinging of the flap back and forwards subsequent to its release.

Figure 3:
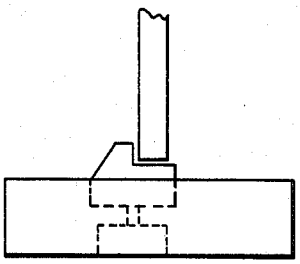
FIGS. 3 and 4 are views of alternative constructions of catch means of the preferred embodiment.

It will be appreciated that the capability of pre-setting the reed switch to a desired sensitivity, and the mounting of the reed switch at a position generally beneath the flap 16, permits an activation of the reed switch, and a consequent release of the catch 24, on movement of the small animal into the opening 12 from either direction. However, where it is not required to restrict exit of the small animal through the cat port, a catch of the construction illustrated in FIG. 3 may be used, the right hand side of the drawing in FIG. 3 indicating the outside of the premises, the left hand side indicating the inside.

Figure 4:
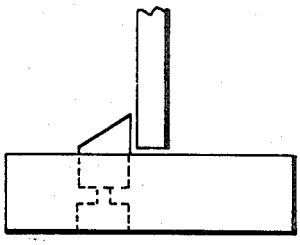

Alternatively, a catch of the kind illustrated in FIG. 4 may be used, the catch in this instance being displaced to the inner side of the flap. It will be appreciated that in the construction illustrated in FIG. 4, the requirement for the timing device to delay re-setting of the reed switch is reduced, since the flap may return to its closed position by an automatic depression of the inclined cam face of the catch.

Figure 6:
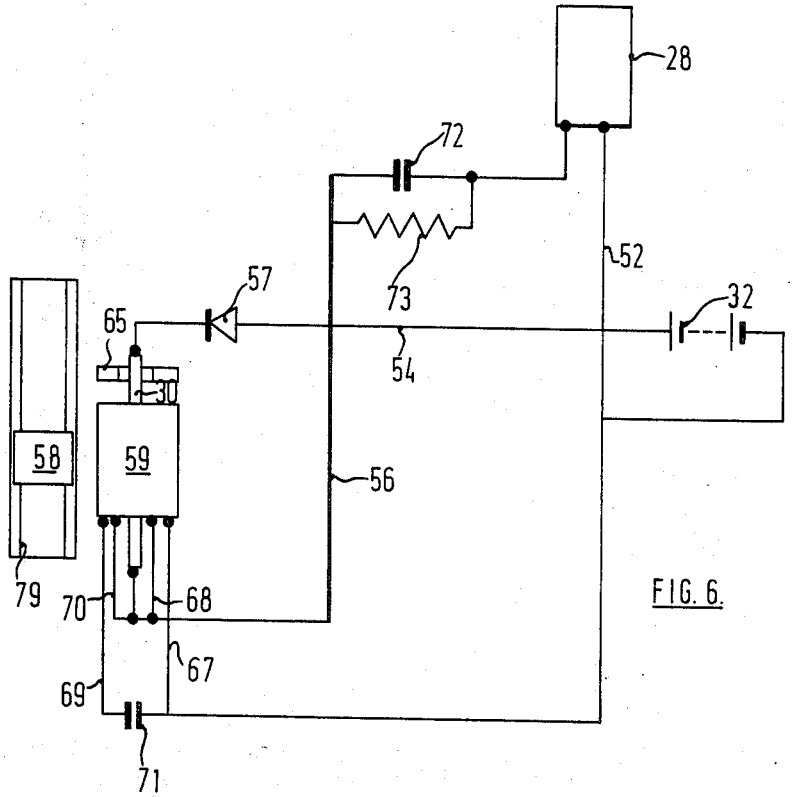
FIG. 6 is a view of an alternative operating circuit of the cat port.

The construction and operation of the operating means illustrated in FIG. 6 is basically similar to that illustrated in FIG. 5, and some of the elements in FIG. 6 are indicated by the same reference numerals. However, in the FIG. 6 construction the delay in operation of the re-setting coil 59' is achieved somewhat differently. In FIG. 6, coil 59' has two windings, a first one of which has one end connected directly to the negative pole of the battery 32 by line 67, and the other end connected to the positive pole via line 68, reed switch 30 and line 54. The second winding of coil 59' has one end connected to the negative pole of the battery 32 by line 69 and a capacitor 71, and the other end connected to the positive pole via line 70, reed switch 30 and line 54. The capacitor 71 has a relatively large value of for example 2000 $\mu$F.

The two windings of the coil 59' are arranged to produce equal and opposite magnetic fields when supplied with equal currents, which is the initial condition when reed switch 30 first closes. However, as capacitor 71 charges up the current through the second winding of the coil 59' falls until eventually the resultant residual magnetic field of the first winding is sufficient to open the reed switch 30. An opening of the reed switch 30, the capacitor 71 discharges in preparation for another cycle of operation.

FIG. 6 also shows a power-saving circuit comprising a capacitor 72 and resistor 73 connected in parallel to the line 56 between the reed switch 30 and solenoid 28. The solenoid 28 requires a less holding current to maintain it depressed than the starting current required to cause initial movement. Thus, upon initial closure of the reed switch 30, the full starting current is applied to the solenoid 28 through the capacitor 72. However, as capacitor 72 charges up increased current must flow through the resistor 73, whose value is selected so that it feeds a reduced holding current, just sufficient to maintain the solenoid depressed, to the solenoid. The combination of the capacitor 72 and resistor 73 could of course be incorporated in the embodiment illustrated in FIG. 5.

As an alternative resetting means, a permanent magnet may be attached to the lower edge of the flap 16, in a position in which it will cause the reed switch to open as the flap 16 returns to its closed position.

Figure 2:
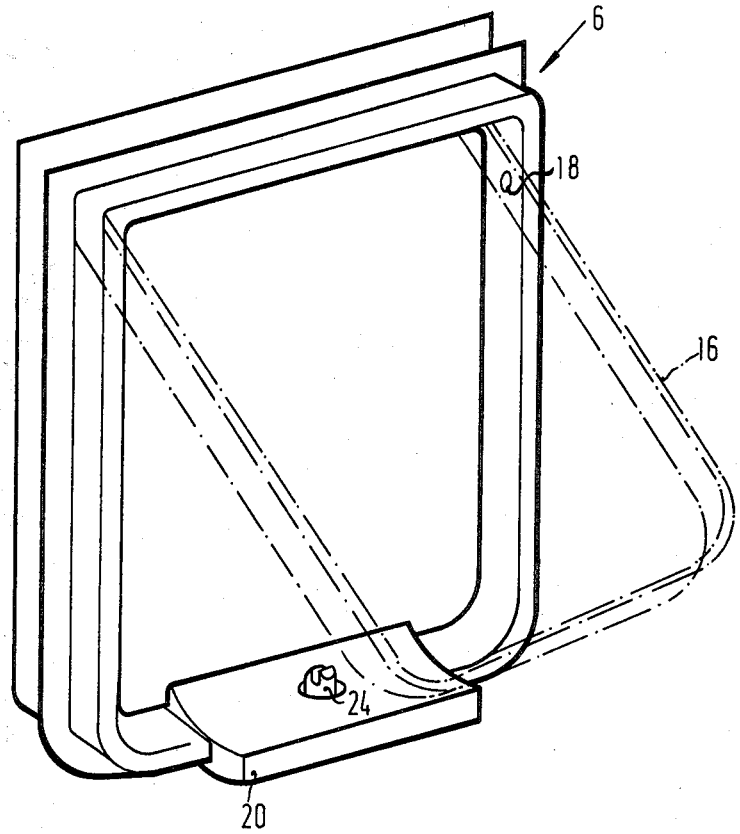
FIG. 2 is a front elevational view of the cat port.
Figure 7:
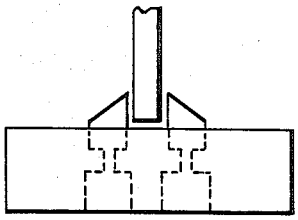
FIG. 7 illustrates a further modification which may be made to the preferred embodiment without departing from the scope of this invention.

Alternative to the catch having a head of the kind illustrated in FIG. 1, being centrally mounted beneath the flap when in its closed position, if desired two solenoids may be used, each comprising a catch, as is illustrated in FIG. 7 of the drawings. On closure of the reed switch 30, both solenoids will be powered allowing the flap 60 to be opened by passage of a small animal therethrough. As with the construction illustrated in FIG. 4, in the construction illustrated in FIG. 6 there is no requirement to delay re-setting of the reed switch 30 subsequent to activation thereof. If, using the FIG. 7 construction, the requirement to control movement of the flap in both directions is no longer required, one or other of the two solenoids may be disconnected from the circuit.

I claim:

1. A cat port comprising:

(a) a framework defining an opening through which a small animal must pass to gain access to, or exit from a designated area, and (b) a flap mounted on the frame within said opening for pivotal movement in both directions from a closed position in which the flap substantially closes the opening, the cat port comprising means for controlling movement of the flap from its closed position, said means comprising:

(i) catch means mounted on the frame and which is movable between an operative position in which it restrains pivotal movement of the flap in at least one of said directions and an inoperative position in which such pivotal movement is permitted, and (ii) operating means mounted on the frame and which may be rendered operative under the action of a first permanent magnet carried by the small animal on movement thereof into close proximity with the cat port to move the catch means to its inoperative position, said operating means comprising a reed switch mounted on the frame, a second permanent magnet mounted adjacent to said switch, the relative dispositions of the reed switch and the second permanent magnet being adjustable to vary the operating threshold of the switch and there is provided a re-setting means to render the read switch inoperative subsequent to activation of said switch.

2. A cat port according to claim 1 wherein the reed switch and the second permanent magnet are mounted on the frame in a manner permitting their magnetic orientations relative to the opening to be reversed.

3. A cat port according to claim 1 wherein the reed switch is operative to cause energisation of a solenoid, said solenoid causing the catch means to move from its operative position to its inoperative position.

4. A cat port according to claim 1 wherein the frame is formed to provide a housing extending beneath the opening, the reed switch being located in the housing at a position generally beneath the flap when in its closed position.

5. A cat port according to claim 1 wherein re-setting means comprises a further permanent magnet mounted on the flap, which is so positioned that, on return of the flap to its closed position subsequent to the passage of a small animal through the opening, and said further permanent magnet renders the reed switch inoperative.

6. A cat port according to claim 1 wherein said re-setting means comprising a re-setting coil, and timing means to cause electric current to be applied to the re-setting coil to cause the coil to generate a re-setting magnetic field, subsequent to the elapse of a predetermined interval of time subsequent to activation of the switch.

7. A cat port according to claim 1 wherein the catch means when in its operative position is effective to prevent pivotal movement of the flap in one direction but to permit free movement in the opposite direction.

8. A cat port according to claim 1 wherein the catch means when in its operative position is effective to prevent pivotal movement of the flap in both directions.

* * * * *